US007630652B2

(12) United States Patent
Hasegawa

(10) Patent No.: US 7,630,652 B2
(45) Date of Patent: Dec. 8, 2009

(54) IMAGE FORMING APPARATUS WITH ENHANCED MAINTAINABILITY

(75) Inventor: Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 328 days.

(21) Appl. No.: 11/830,380

(22) Filed: Jul. 30, 2007

(65) Prior Publication Data

US 2008/0310862 A1 Dec. 18, 2008

(30) Foreign Application Priority Data

Aug. 4, 2006 (JP) ..... 2006-213106

(51) Int. Cl.
*G03G 15/00* (2006.01)
*G03G 15/16* (2006.01)

(52) U.S. Cl. ..... 399/13; 399/122

(58) Field of Classification Search ..... 399/33, 399/31, 13, 110, 122
See application file for complete search history.

(56) References Cited

U.S. PATENT DOCUMENTS 5,103,259 A * 4/1992 Saitoh et al. ..... 399/13
6,647,218 B2 * 11/2003 Takayama ..... 399/33
2006/0029411 A1 2/2006 Ishii
2007/0014600 A1 1/2007 Ishii
2007/0077104 A1 4/2007 Hasegawa

FOREIGN PATENT DOCUMENTS

JP 09-080943 3/1997
JP 2004-012823 1/2004
JP 2005-070321 3/2005

* cited by examiner

*Primary Examiner*—Susan S Lee
(74) *Attorney, Agent, or Firm*—Harness, Dickey & Pierce, P.L.C.

(57) ABSTRACT

An image forming apparatus at least includes: a component, detachable from the image forming apparatus, including a driven portion; first and second detectors configured to detect an installation of the component in the image forming apparatus and driving of the driven portion, respectively; an indicator device configured to communicate information to a user; and a controller to control the indicator device. In a circumstance in which neither an occurrence of installation nor driving of the driven portion are detected, the controller outputs a first notification requesting a proper installation of the component when a first count of occurrences of the first notification or a second count of occurrences of cancellation of the first notification is less than first and second reference values, respectively, and a second notification requesting repair when the first count or the second count equals the first and second reference values, respectively.

20 Claims, 10 Drawing Sheets

IMAGE FORMING APPARATUS WITH ENHANCED MAINTAINABILITY

CROSS REFERENCE TO RELATED APPLICATIONS

The present patent application is based on and claims priority under 35 U.S.C. §119 upon Japanese Patent Application No. JP2006-213106 filed on Aug. 4, 2006 in the Japan Patent Office, the entire contents of which are incorporated herein by reference.

BACKGROUND OF THE INVENTION

1. Field of the Invention

Example aspects of the present invention generally relate to an image forming apparatus, for example a copier, a printer, a facsimile, a multifunctional, etc., and more particularly to an image forming apparatus including a component attachably/detachably disposed relative to the image forming apparatus.

2. Discussion of the Background

According to related arts, image forming apparatuses which attachably and detectably include components such as a fixing unit, a charging unit, an exposure unit, a developing unit, a cleaning unit, a photoreceptor drum, a transfer unit, a process cartridge and so forth have been known.

When such components are attachable/detachable or replaceable relative to the image forming apparatus, it facilitates maintenance of the image forming apparatus.

Such an image forming apparatus is most likely to report on a display area a need for repair of the image forming apparatus, when the image forming apparatus detects a problem in any of the detachable components.

When the image forming apparatus detects a problem in the detachable component, the display area of the apparatus may display a notice, for example, "Call Repair Personnel", to request for a need to repair by a repair personnel.

When such a notice is displayed, the image forming apparatus is controlled such that the image forming apparatus does not operate until the repair by the repair personnel is completed.

In a case where the detachable component is not properly installed in the image forming apparatus, the image forming apparatus detects such a state and often notifies a user by displaying a request for a proper installation of the detachable component.

The installation of the component to the image forming apparatus main body is performed by detecting whether or not exchange of electric power between the image forming apparatus main body and the component is performed.

In a case where connecters for the electric power exchange between the image forming apparatus main body and the component are not connected so that a conductive state is not confirmed, it is detected that the component is not properly installed in the image forming apparatus main body.

Based on the detection result, a notification for requesting the user to reinstall the component, for example, "Device is not properly installed. Please reinstall." may be displayed. The detachment/installation operation of the component may be performed by the user at ease without a repair personnel.

Thus, the notification for requesting the user to reinstall the component is displayed separately from the notification for requesting a repair personnel to fix the problem.

In related art image forming apparatuses, even though the component is not properly installed in the image forming apparatus main body, this state is not properly detected. Consequently, the driven portion of the component is detected as being not properly driven so that a notice requesting a repair personnel to repair the problem is displayed.

In other words, even if the problem is most likely to be solved by reinstallation of the component by the user, the problem may be perceived as a problem that requires a repair operation by a repair personnel. As a result, the image forming apparatus may shut down regardless of types of a problem.

Even if a gear of a drive unit or a driver disposed in the image forming apparatus and a gear of the component for transmitting a driving force to the driven unit are not sufficiently meshed, the connecters for the electric power exchange between the image forming apparatus main body and the component are connected so that a conductive state may be generated.

In other words, even if the both gears are not sufficiently meshed with one another, and the driving force is not transmitted to the component, the component may be detected as being properly installed in the image forming apparatus main body.

Subsequently, the image forming apparatus detects that the driven unit is not properly driven. Thus, a display requesting a repair personnel, for example, "Call Repair Personnel" may be displayed.

Particularly, in the fixing unit, when recovering from paper jams, the fixing unit is taken out of the image forming apparatus main body. The driven unit is manually rotated so as to remove the jammed paper. Subsequently, the fixing unit is reinstalled.

For this reason, a problem that the gears of both the driver in the image forming apparatus and the component for transmitting a driving force to the driven unit are not meshed may easily be generated.

SUMMARY

An embodiment according to the present invention provides an image forming apparatus including: a component, detachable from the image forming apparatus, including a driven portion; first and second detectors configured to detect an installation of the component in the image forming apparatus and driving of the driven portion, respectively; an indicator device configured to communicate information to a user; and a controller to control the indicator device. In a circumstance in which neither an occurrence of installation nor driving of the driven portion are detected, the controller outputs a first notification requesting a proper installation of the component when a first count of occurrences of the first notification or a second count of occurrences of cancellation of the first notification is less than first and second reference values, respectively, and a second notification requesting repair when the first count or the second count equals the first and second reference values, respectively.

An embodiment according to the present invention provides a method of outputting a notification from such an image forming apparatus.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
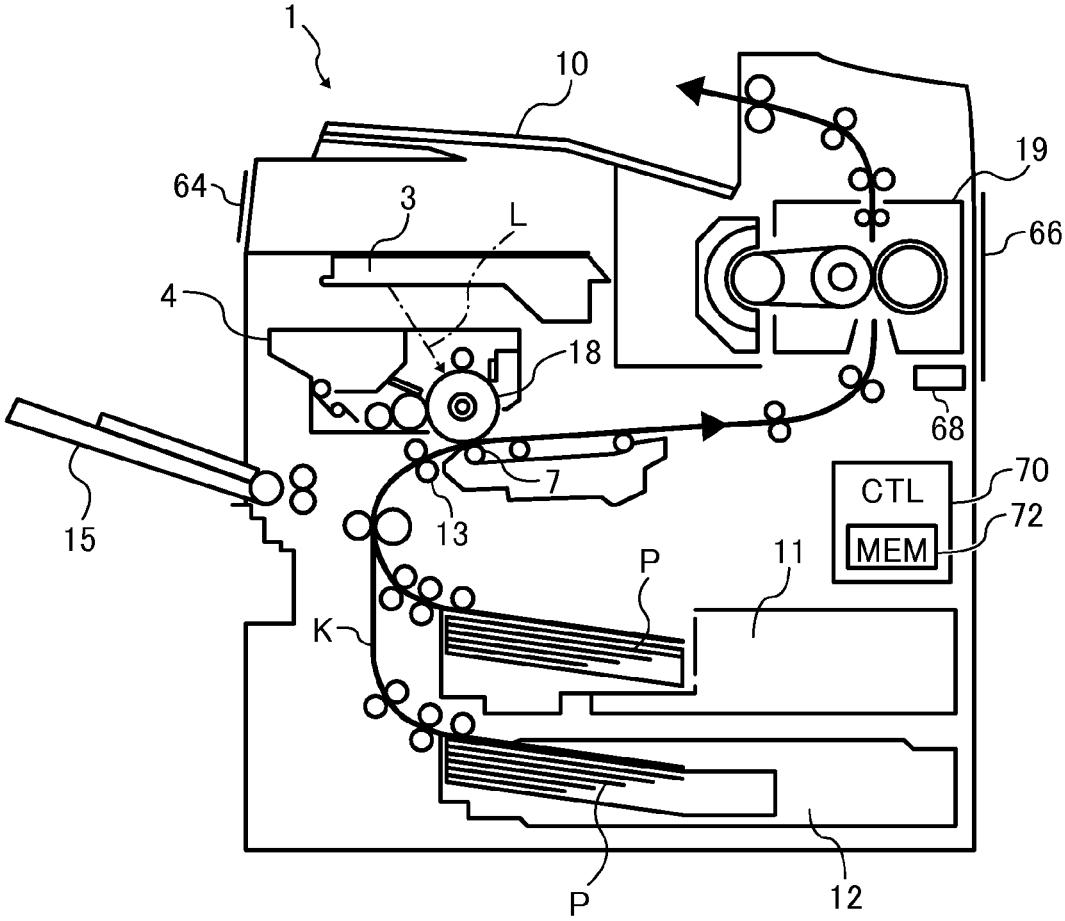
FIG. 1 is a schematic diagram illustrating an image forming apparatus according to an example embodiment of the present invention.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on," "directly connected to" or "directly coupled to" another element or layer, then there are no intervening elements or layers present.

Like numbers refer to like elements throughout figures. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below.

The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Example embodiments of the present invention are now explained below with reference to the accompanying drawings.

In the later described comparative example, example embodiment, and alternative example, for the sake of simplicity of drawings and descriptions, the same reference numerals will be given to constituent elements such as parts and materials having the same functions, and the descriptions thereof will be omitted unless otherwise stated.

Typically, but not necessarily, references to paper refers to a medium on which an image is formed. Other printable media are available in the form of sheets and their use here is included.

For simplicity, this Detailed Description section refers to paper, sheets thereof, paper feeder, etc. It should be understood, however, that the sheets, etc., are not limited only to paper.

Referring now to the drawings, wherein like reference numerals designate identical or corresponding parts throughout the several views, particularly to FIG. 1, a structure and a function of an image forming apparatus according to a first example embodiment of the present invention is described.

With reference to FIGS. 1 through 9, a detailed description will be given of the first example embodiment of the present invention.

With reference to FIG. 1, a description will be given of the structure and the operation of the image forming apparatus 1, for example a laser printer.

In FIG. 1, the image forming apparatus 1 in one embodiment may include: an exposure unit 3, a photoreceptor drum 18 serving as an image carrier, a process cartridge 4, a transfer unit 7, a catch tray 10, sheet feed units 11 and 12, a resist roller 13, a manual sheet feed unit 15, a fixing unit 19; and a control unit 70, e.g., a programmable processor (control unit 70 itself including a memory 72, e.g., a non-volatile memory). Alternatively, the memory 72 may be included within the image forming apparatus 1 but not within the control unit 70.

The exposure unit 3 is configured to irradiate the photoreceptor drum 18 with an exposure light L based on image information.

The process cartridge 4 is configured to serve as an image forming unit and is configured to be attachably/detachably disposed in the laser printer 1.

The transfer unit 7 is configured to transfer a toner image formed on the photoreceptor drum 18 onto a recording medium P, for example, paper or any other desired recording medium.

An image output is placed on the catch tray 10.

The sheet feed units or the sheet feed cassettes 11 and 12 are configured to store the recording medium P.

The resist roller 13 is configured to transport the recording paper P to the transfer unit 7.

The fixing unit 19 is configured to fix the image or the toner image on the recording medium P which has not been fixed.

With reference to FIG. 1, a description will be given of a normal operation of the image forming apparatus 1 according to one example embodiment of the present invention.

First, the exposure light L, for example, the exposure unit 3 is configured to irradiate the photoreceptor drum 18 of the process cartridge 4 with a laser beam based on the image information.

The photoreceptor drum 18 is configured to rotate in a counterclockwise direction and is subjected to an electrophotographic processes, for example, a charging process, an exposure process, and a developing process.

After the electrophotographic processes are performed, a toner image corresponding to image information is formed on the photoreceptor drum 18.

Subsequently, in the transfer unit 7 the toner image formed on the photoreceptor drum 18 is transferred on the recording medium P transported by the resist roller 13.

Although not shown except the photoreceptor drum 18, the process cartridge 4 may integrally include a charging unit for charging the surface of the photoreceptor 18; a developing unit storing toner or a developer for developing an electrostatic latent image formed on the photoreceptor drum 18; a cleaning unit for removing residual toner which has not been transferred and thus remains on the photoreceptor drum 18 and so forth.

A description will be given of the recording medium P as follows.

First, a sheet feed unit is automatically or manually selected from one of the plurality of sheet feed units 11, 12 and 15 of the laser printer 1. For example, the sheet feed unit 11 on the top may be selected.

A sheet which is a top sheet of the recording medium P stored in the sheet feed unit 11 is transported to a sheet conveyance path K.

Subsequently, the recording medium P arrives at the resist roller 13 by way of the sheet conveyance path K. When the recording medium P arrives at the resist roller 13, the recording medium P is transported to the transfer unit 7 at a timing when the recording medium P aligns with the position of the toner image formed on the photoreceptor drum 18.

After the transfer process is performed, the recording medium P passes the transfer unit 7 and arrives at the fixing unit 19 through the sheet conveyance path K. When the recording medium P arrives at the fixing unit 19, the recording medium P is inserted between a fixing belt and a pressing roller so that the toner image is fixed by the heat from the fixing belt and the pressure from the pressure roller.

After the recording medium P on which the toner image is fixed is sent out from the space between the fixing belt and the pressure roller, the recording medium P is discharged from the image forming apparatus 1 as an output image and is placed on the catch tray 1.

Thereby, a series of the image forming processes is completed.

Figure 2:
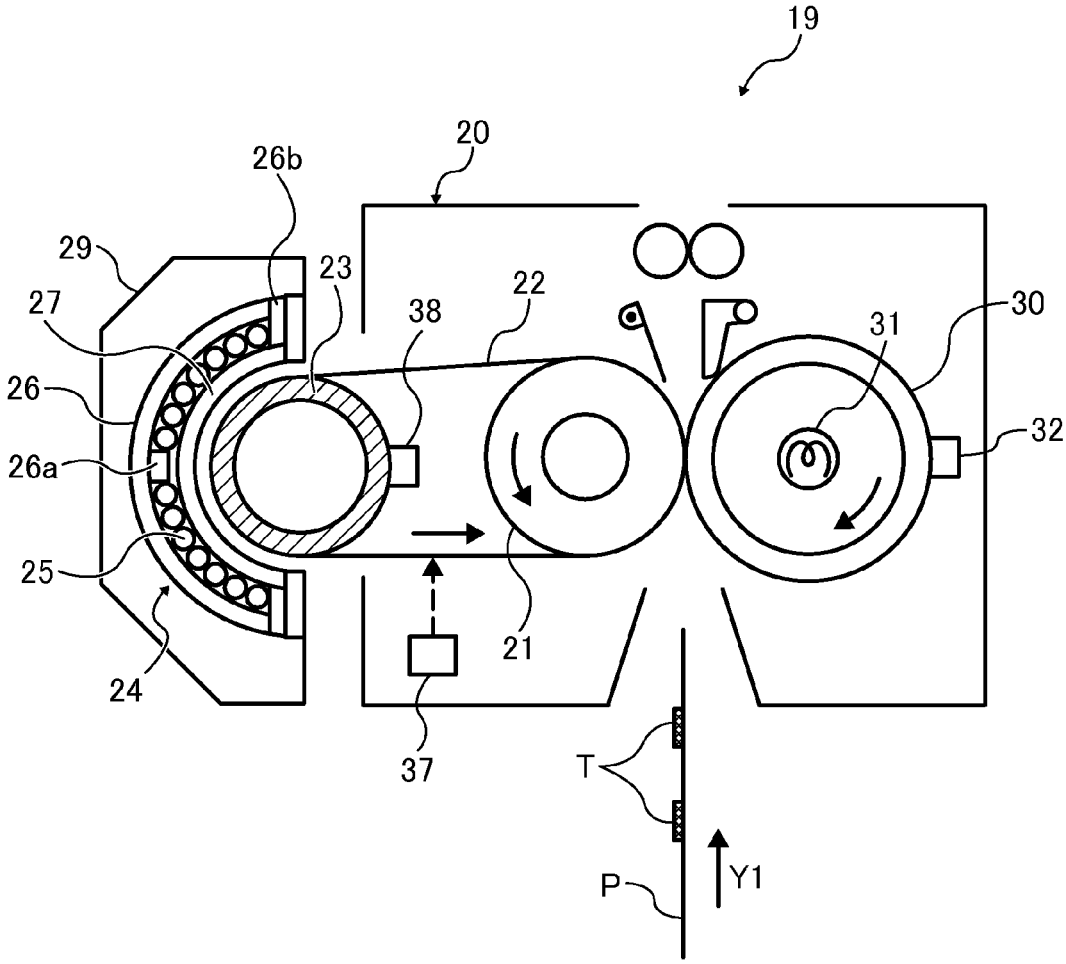
FIG. 2 is cross-sectional view (according to an example embodiment of the present invention) illustrating a fixing unit disposed in the image forming apparatus of FIG. 1.
Figure 3:
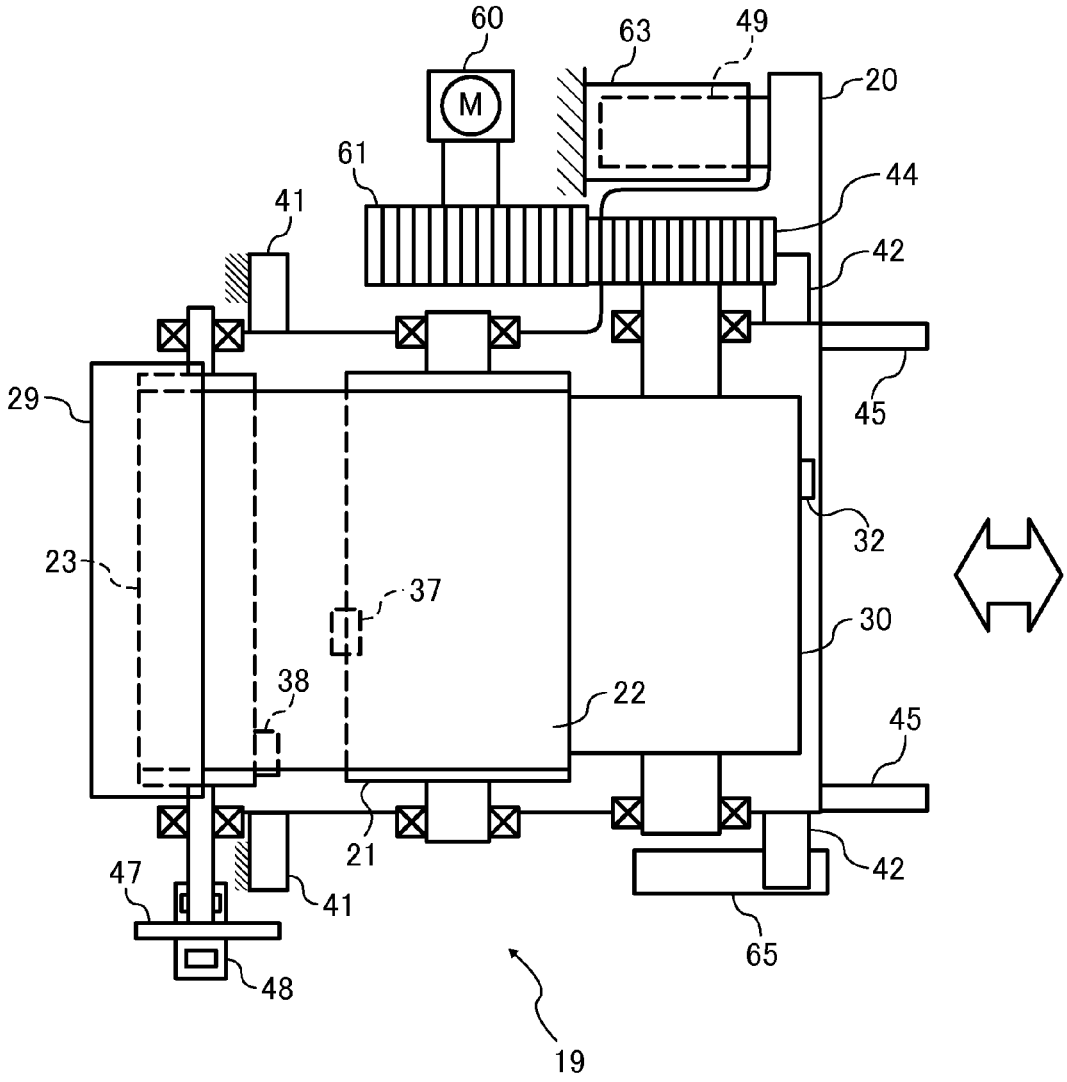
FIG. 3 is a top view illustrating the fixing unit of FIG. 2.
Figure 4:
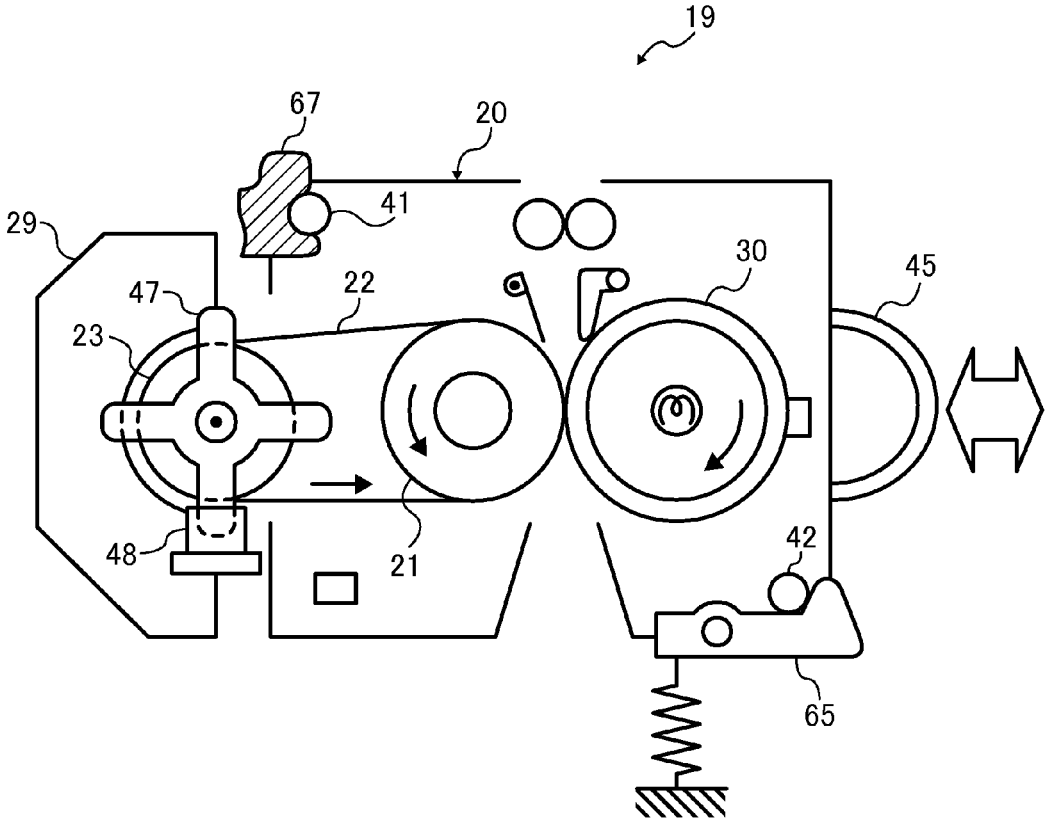
FIG. 4 is another schematic diagram (according to an example embodiment of the present invention) illustrating the fixing unit according to the example embodiment.

Referring now to FIGS. 2 through 4, a description will be given of a structure and an operation of the fixing unit 19 disposed in the image forming apparatus 1.

The fixing unit 19 according to a first example embodiment may have a structure allowing the fixing unit 19 to be attached and detached from the image forming apparatus 1. In other words, the fixing unit 19 may be replaceable relative to the image forming apparatus 1. For example, the fixing unit 19 can be inserted/removed into/from the image forming apparatus 1 via a door/cover 66. A sensor 68 can be provided to sense whether the 66 is open or closed.

As shown in FIG. 2, according to one embodiment of the present invention, the fixing unit 19 may include an induction heater 24, a fixing auxiliary roller 21, a fixing belt 22, a supporting roller or heating roller 23, a pressure roller 30 and so forth.

The fixing auxiliary roller 21 may include an elastic layer, for example, a silicone rubber or the like on a surface of a metal shaft of a stainless steel or the like. The elastic layer of the fixing auxiliary roller 21 may have a thickness between 1 and 5 mm, and an Asker C hardness between 30 and 60.

The fixing auxiliary roller 21 is fixed to a second holder 20 through a bearing and rotatively driven in a counterclockwise direction shown in FIG. 2. The holder 20 serves as a part of a chassis of the fixing unit 19.

The supporting roller 23 may include a cylindrical member with a low heat capacity made of a magnetic metal material such as iron, cobalt, nickel, stainless steel or alloy of those materials.

The outside diameter of the cylindrical member 23 of the supporting member may be 20 mm and the thickness thereof may be 1 mm. The supporting member 23 is held by the second holder 20 through a bearing and rotatively driven in a counterclockwise direction shown in FIG. 2.

The fixing belt 22 serving as a fixing member is spanned between two roller members, that is, the supporting roller 23 and the fixing auxiliary roller 21.

The fixing belt 22 is, for example, an endless belt and at least includes multiple layers including a base layer of polyimide or the like, a exothermic layer of a metal such as nickel or silver, an elastic layer of a silicone rubber, and a release layer of fluorine compound.

The release layer of the fixing belt 22 may secure releasing ability relative to toner T.

In an alternative embodiment, a exothermic layer of the fixing belt 22 may include a multi-layered structure having a resin layer and a metal layer.

The resin layer is, for example, a fluoroplastic resin, a polyimide resin, a polyamide-imide resin, a PEEK resin, a PES resin, a PPS resin, and so forth. The metal layer may be of nickel or the like.

The pressure roller 30 may include a cylindrical member of aluminum, copper or any other suitable material over which an elastic layer of a fluorocarbon rubber, a silicone rubber or the like is formed.

The pressure roller 30 comes into contact with a peripheral surface of the fixing belt 22 to form a nip.

The elastic layer of the pressure roller 30 may have a thickness between 0.5 and 2 mm, and an Asker C hardness between 60 and 90.

The pressure roller 30 presses the fixing auxiliary roller 21 through the fixing belt 22.

The recording medium P is transported to a place where the fixing belt 22 and the pressure roller 30 abut, that is, a fixing nip portion.

According to the first example embodiment, there is provided a heater 31 in the heating roller 30. Thereby, the efficiency of a temperature rise of the fixing unit 19 may be enhanced.

A thermistor 32 is disposed abutting the peripheral surface of the pressure roller 30. Based on the detection result of the thermistor 32, the heater 31 regulates the thermal dose.

The induction heater 24 serving as a magnetic flux generator may include a coil portion 25 serving as a magnetizing coil, a core 26 serving as a magnetizing coil core, a coil guide 27 and so forth.

The coil portion 25 is structured such that a litz wire including bundled fine lines is wound on the coil guide 27 disposed covering the periphery of the fixing belt 22.

The fixing belt 22 is wound on the supporting roller 23. The coil portion 25 extends in a width direction, that is, a vertical direction of FIG. 2

The coil guide 27 may be formed of a semicylindrical member of a resin material having a high thermal resistance or an insulator of glass or the like. The coil guide 27 holds the coil member 25.

The core 26 may be formed of a semicylindrical member of ferromagnetic, for example, ferrite with a relative permeability approximately between 1000 and 3000. The core 26 may include a center core 26*a* and a side core 26*b* for forming a magnetic flux efficient for the heating element.

The core 26 is disposed facing the coil portion 25 extended in the width direction. The induction heater 24 is held by a first holder 29 serving as a part of the chassis of the fixing unit 19.

With reference to FIG. 2, a thermopile 37 is disposed across from the center in the width direction of the peripheral surface of the fixing belt 22. The thermopile 37 detects the temperature of the surface of the fixing belt 22 without contacting the fixing belt 22.

Based on the detection result of the thermopile 37, the thermal dose of the induction heater 24 is adjusted.

A thermostat 38 is in contact with the peripheral surface of the supporting roller 23. In a case where the surface temperature of the supporting roller 23 exceeds a reference temperature, the power distribution to the induction heater 24 is cut off by the thermostat 38.

Therefore, overheating of the supporting roller 23 by the induction heater 24 may be prevented.

In the fixing unit 19, the pressure roller 30 is rotatively driven causing the fixing belt 22 and the fixing auxiliary roller 21 to rotate in the direction shown by an arrow in FIG. 2. At the same time, the supporting roller 23 may rotate in a counterclockwise direction.

The fixing belt 22 is heated at a position opposite to the induction heater 24 by the magnetic flux generated by the induction heater 24.

When a high frequency alternate current, e.g., between 10 kHz and 1 MHz, e.g., preferably between 20 kHz and 800 kHz flows, a magnetic field line is formed such that the direction thereof may alternately be switched between the fixing belt 22 and the supporting roller 23.

When an alternating field is formed in such a manner, an eddy current is generated on the surface of the supporting roller 23 and the exothermic layer of the fixing belt 22. The electric resistance of the supporting roller 23 and the exothermic layer may generate a module heat so that the supporting roller 23 and the exothermic layer are heated.

Accordingly, the surface of the fixing belt 22 is heated by the heat from the supporting roller 23 and the self heat of the exothermic layer of the fixing belt 22

Subsequently, the surface of the fixing belt 22 heated by the induction heater 24 arrives at the position where the pressure roller 30 abuts the surface of the fixing belt 22. The toner image T on the recording medium being transported is heated and fused.

Specifically, as shown by an arrow Y1 in FIG. 2, the recording medium P carrying the toner image T after the above-described image forming process is guided to the space between the fixing belt 22 and the pressure roller 30, that is, the fixing nip, by the guide plate.

The heat from the fixing belt 22 and the pressure from the pressure roller 30 fix the toner image T on the recording medium P.

Subsequently, the recording medium P is sent out from the space between the fixing belt 22 and the pressure roller 30.

The surface of the fixing belt 22 which has passed the fixing position may arrive again at the position opposite to the induction heater 24. Such a sequence of the operations may repeatedly be performed, and the fixing process in the image forming process is completed.

Next, a description will be given of an attachment/detachment operation of the fixing unit 19 relative to the image forming apparatus 1.

With reference to FIGS. 3 and 4, a user may attach or detach the fixing unit 19 from the image forming apparatus 1 in a direction shown by an arrow while holding a holder 45.

When installing the fixing unit 19 in the image forming apparatus 1, the cover of the image forming apparatus 1 (not shown) is opened, and the fixing unit 19 is pushed into the left direction of FIGS. 3 and 4.

Accordingly, the fixing unit 19 is guided by the slide rail (not shown) and is positioned at a given position of the image forming apparatus 1.

A main reference pin 41 provided to the second holder 20 or the chassis of the fixing unit 19 may engage with an engagement member 67 of the image forming apparatus 1.

A sub reference pin 42 provided to the second holder 20 or the chassis of the fixing unit 19 may engage with a lever 65 of the image forming apparatus 1.

As shown in FIG. 3 (also shown in FIG. 6B) according to one embodiment of the present invention, a driven gear 44 provided to a shaft of the pressure roller 30 may engage with a drive gear 61 provided to a motor shaft of the drive motor 60 of the image forming apparatus 1.

Thereby, it is possible to transmit a driving force to the fixing unit 19 by the drive motor 60 serving as a driving member. The driving force of the drive motor 60 is transmitted to the pressure roller 30 through the drive gear 61 and the driven gear 44.

The frictional force between the pressure roller 30 and the fixing belt 22, and of the fixing auxiliary roller 21 may cause the fixing belt 22 and the fixing auxiliary roller 21 to rotatively move.

Furthermore, the frictional force between the fixing belt 22 and the supporting roller 23 may cause the supporting roller 23 which is a rotary member to rotatively move.

A detected plate 47 which rotates with the supporting roller 23 is provided to the shaft of the supporting roller 23 as a driven member (a rotary member). As shown in FIG. 4, the detected plate 47 may have a propeller-shape.

A photosensor 48 serving as a second detection mechanism is provided to the image forming apparatus 1 or to the holder 20 and 29 side, having the detected plate 47 therebetween.

The photosensor 48 serving as the second detector may include a light emitting element and a light receiving element, and optically detects the propeller of the detected plate 47.

Therefore, the operation or the rotary motion of the supporting roller 23 which is a driven member is detected.

When there is a change in an output of the photosensor 48, that is, there is ON and OFF of the output of the photosensor 48, it is determined that the supporting roller 23 is operated.

On the other hand, when there is no change in the output of the photosensor 48, that is, there is no ON and OFF of the output of the photosensor 48, it is determined that the supporting roller 23 is not operated.

Figure 6:
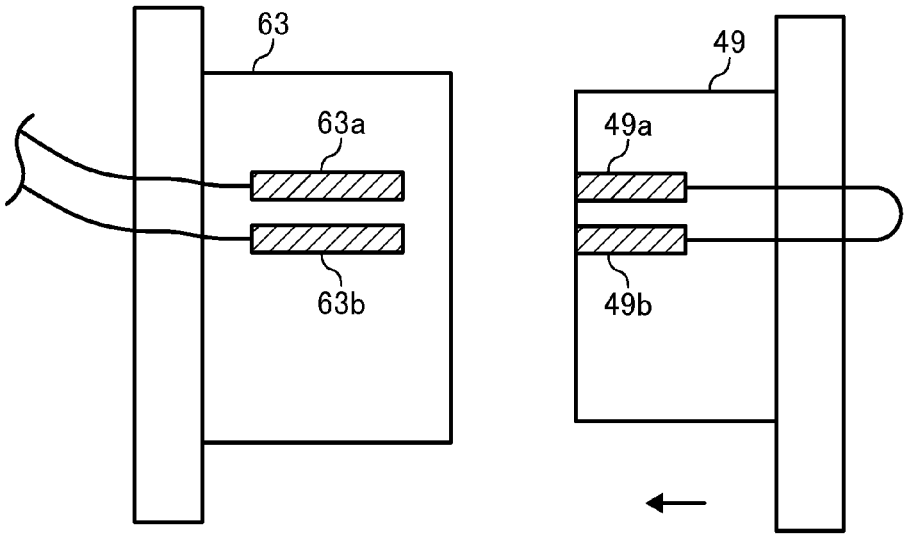
FIG. 6 is a schematic diagram (according to an example embodiment of the present invention) illustrating a connector of the image forming apparatus and a connector of the fixing unit according to the example embodiment.

When the fixing unit 19 is set or installed in the image forming apparatus 1, a connector 49, or a drawer connector shown in FIG. 6 provided to the fixing unit 19 is connected to a connector 63 provided to the image forming apparatus 1 so that it is possible to exchange electric power between the image forming apparatus 1 and the fixing unit 19.

In other words, it is possible to supply electric power from the power source of the image forming apparatus 1 to the induction heater 24 and the heater 31 of the pressure roller 30.

Accordingly, it is possible to exchange signals of the thermostat 38 and the thermopile 37.

Referring now to FIG. 6, according to the first example embodiment, when both connectors 49 and 63 are connected, pins 49*a* and 49*b* of the connector 49, and pins 63*a* and 63*b* of the connector 63 may electrically be connected, and the pins 63*a* and 63*b* at the image forming apparatus 1 are conducted.

Thereby, the control unit 70 of the image forming apparatus 1 recognizes the connection between the connectors 49 and 63 and thus determines that the fixing unit 19 is set or installed in the image forming apparatus 1.

In other words, the connectors 49 and 63, and the control unit 70 may serve as a first detector which may detect the installation of the fixing unit 19 in the image forming apparatus 1.

The description provided above explains the operations when the fixing unit 19 is installed in the image forming apparatus 1. When taking out the fixing unit 19 from the image forming apparatus 1, the backward operations may be performed.

When the cover or the door 66 to the image forming apparatus 1 is opened or closed so as to attach or detach the fixing unit 19, the door sensor 68 serving as a third detector detects the open/closed state of the door 66.

In other words, the door sensor 68 serving as the third detector detects whether the fixing unit 19 is ready to install.

The door sensor 68 may be a push-type sensor which may extend and contract in conjunction with an open and close motion of the door 66.

A display/operation panel or a display portion serving as an indicator device 64 may be provided to an external cover of the image forming apparatus 1 where it is most likely to be seen by the user.

The display/operation panel may serve as an indicator device 64 for notifying or announcing to the user various information associated with the image forming apparatus 1. The display/operation panel may also serve as an input portion for allowing the user to input operation information.

According to the first example embodiment, notification may be made to the user using characters and symbols. However, in an alternative embodiment, notification may be made to the user using audio.

Figures 7, 7A, 7B:
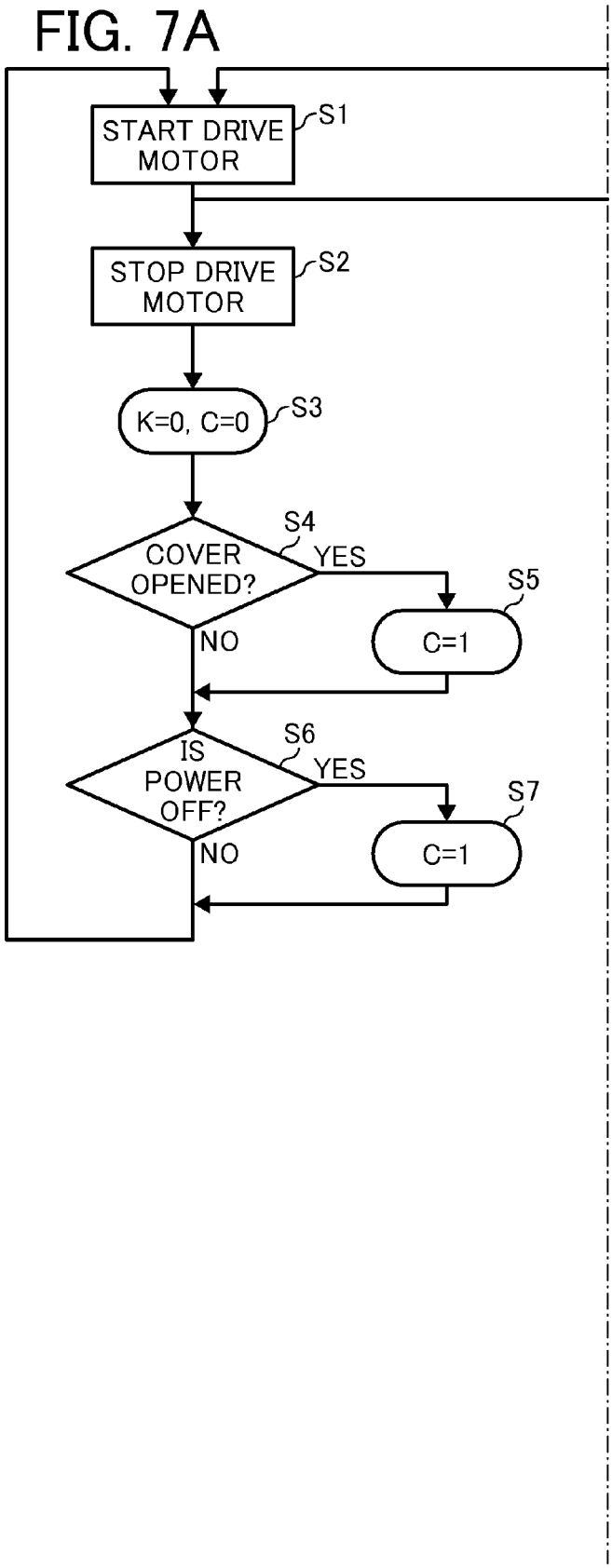
FIGS. 7A-7B together represent a flowchart showing an example notification procedure according to an example embodiment of the present invention.
Figure 7B:
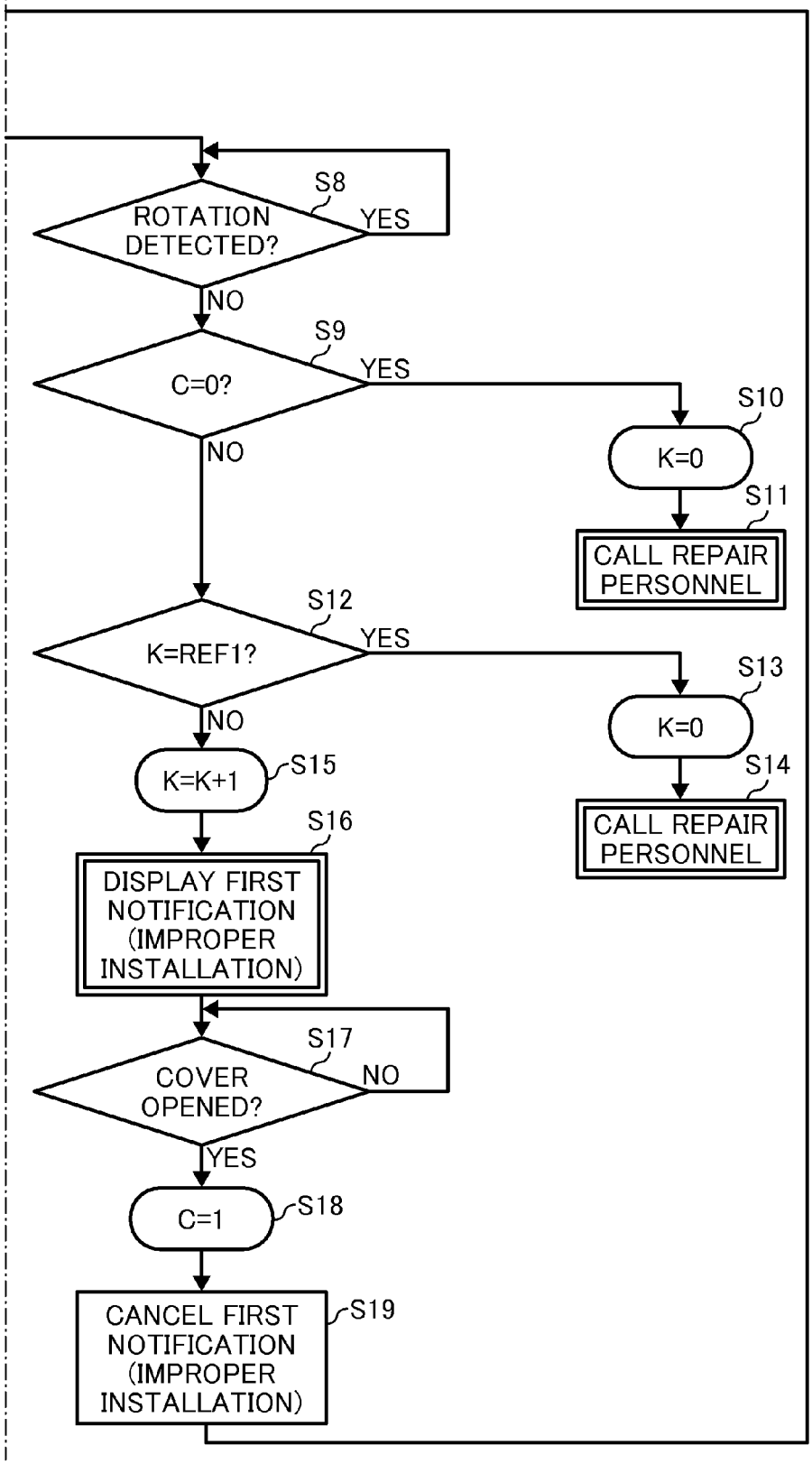

Referring now to FIGS. 7A-7B, a description will be given of an example notification procedure according to the first example embodiment.

FIG. 7B is a flowchart showing an example notification procedure performed (e.g., by the control unit 70) when the photosensor 48 serving as the second detector detects an abnormal behavior in the fixing unit 19. FIG. 7A is a flowchart (e.g., performed by the control unit 70) for related control operations vis-à-vis FIG. 7B, and as such FIG. 7A establishes context for FIG. 7B.

The drive motor 60 serving as a driving mechanism is initiated in Step S1. From Step S1, flow proceeds to both Step S2 (FIG. 7A) and Step S8 (FIG. 7B). In other words, Step S1 is common to both of FIGS. 7A and 7B.

When the drive motor 60 stops without an abnormal behavior (Step S2), 0 (zero) may be entered in a variable K and a variable C, and stored in the memory 72 in Step S3.

The variable K may indicate a number/count of occurrences of a first notification having been made on the indicator device 64, e.g., the display/operation panel, so as to request the user to properly install the fixing unit 19.

A first notification is, for example, "The fixing unit is not properly installed. Please reinstall", and may be displayed through character representation.

When the variable K indicates 0 (K=0) in Step S3, the number of the first notification reporting an improper installation made is zero (0), which is an initial value.

The variable K may be stored in the memory 72. If the memory 72 is non-volatile, then the value at the time the power was turned on is preserved even if the power of the image forming apparatus 1 is turned off.

Furthermore, the first notification is displayed in principle when the first detector does not confirm the conduction between the connector 49 and 63.

The variable C may indicate an opening and closing state of the cover/door 66 for a removal operation of the fixing unit 19.

When the variable C indicates "0" in Step S3, the cover is closed. When the variable C indicates "1", the cover has been opened and closed.

In principle, when the above described door sensor 68 as the third detector detects that the door 66 is opened, "1" is entered in the variable C. Therefore, when the variable C indicates 1 (C=1), there is a possibility that the detachment/installation of the fixing unit 19 has been performed, and that there is a problem in the installation of the fixing unit 19.

On the other hand, when the variable C indicates 0 (C=0) after the drive motor 60 stops, no detachment/installation of the fixing unit 19 has been performed. Therefore, there may not be a problem in the installation of the fixing unit 19.

Subsequent to Step S3, in Step S4, the door sensor 68 as the third detector determines whether or not the cover or the door 66 has been opened and closed.

As described above, when the cover has been opened and closed (YES in Step S4), "1" is entered in the variable C in Step 5.

When the cover has not been opened and closed (NO in Step S4), the procedure may advance to Step S6. Subsequently, whether or not the power of the image forming apparatus 1 is turned off is determined in Step S6.

When the power of the image forming apparatus 1 is turned off (YES in Step S6), "1" is entered in the variable C in Step S7.

When the power of the image forming apparatus 1 is not turned off (NO in Step S6), the procedure may return to Step S1 and may repeat the procedure of Step S2 and beyond.

Because there is a possibility that the detachment/installation operation of the fixing unit 19 may be performed while the power is off, "1" is entered in the variable C regardless of the stored result in the memory 72.

Next, a description will be given of the example procedure of the detection of an abnormal behavior in the fixing unit 19 in Step S8 and beyond.

When the drive motor 60 is initiated, the photosensor 48 which is the second detector may detect the driving or the rotation of the supporting roller 23 as a driven member in Step S8.

When the result is YES in Step S8, that is, the photosensor 48 detects that the supporting roller 23 is properly driven, the photosensor 48 may resume detection. The detailed description of the control performed by the photosensor 48 will be later provided with reference to FIGS. 8 and 9.

On the other hand, when the result is NO in Step S8, that is, the photosensor 48 does not detect the driving or the rotation of the supporting roller 23, whether or not the variable C indicates 0 (C=0) is determined in Step S9.

When the result is YES in Step S9, that is, the variable C indicates 0 (C=0), the detachment/installation operation of the fixing unit 19 may have not been performed, and thus there may not be a problem in the installation of the fixing unit 19. Accordingly, "0" is entered in the variable K in Step S10.

Subsequently, in Step S11, a second notification requesting the user to repair the fixing unit 19, is made on the indicator device 64, e.g., the display/operation panel.

The second notification may be a notification requesting the user to call a repair personnel to repair the problem.

For example, a character representation of a message such as "Problem occurred. Call repair personnel" may be displayed. When such a message is displayed, the image forming apparatus 1 is controlled such that the operation thereof is stopped until the repair by the repair personnel is completed.

On the other hand, when the result is NO in Step S9, that is, when the variable C does not indicate 0 or the variable C indicates 1 (C=1), it is assumed that the cover has been opened and closed, and that the installation of the fixing unit 19 has not been properly performed. Flow proceeds to Step S12 where it is determined whether or not the variable K indicates REF1 (a reference number), e.g., REF1=1 such that the determination is whether K=1.

When the result is YES in Step S12, that is, the variable K indicates REF1, it is expected that the first notification has been made once before, and the user has reinstalled the fixing unit 19.

Therefore, the problem in the driving of the supporting roller 23 may not be associated with the installation of the fixing unit 19. Consequently, in Step S13, "0" is entered in the variable K without making the first notification again.

Subsequently, in Step S14 the second notification requesting the user to call a repair personnel may be made on the indicator device 64.

When the photosensor 48 which is the second detector detects an operation problem in the supporting roller 23 (driven member), there are at least four possible causes of the problem that the photosensor 48 may detect.

In other words, there are at least four possible causes that may cause the supporting roller 23 not to rotate.

First, the drive transmission system between the drive motor 60 and the driven gear 40 may be damaged.

Second, the driving force may not properly be transmitted due to improper installation of the fixing unit 19.

Third, there is a slip of the fixing belt 22 and the fixing auxiliary roller 21 relative to the pressure roller 30.

Lastly, there is a slip of the supporting roller 23 relative to the fixing belt 22.

The second problem may be solved by the user him/herself without making a request for a repair personnel to repair the problem.

However, except for the second problem, it may be necessary to make a request to the repair personnel to repair the problems.

Therefore, when it is determined in Step S12 that the cause of the problem is other than the second cause described above, the second notification requesting the user to call a repair personnel may be made.

When the connectors 49 and 63 serving as the first detectors perform detection of a problem in the installation of the fixing unit 19, but the connectors 49 and 63 may not be able to detect the problem, the photosensor 48 serving as the second detector may detect a problem in the driving of the supporting roller 23, instead.

Even if the drive gear 61 provided to the image forming apparatus 1 and the driven gear 44 provided to the fixing unit 19 are not properly meshed with each other, the connector 63 of the image forming apparatus 1 and the connector 49 of the fixing unit 19 are connected, and thus are conducted.

Figure 5A:
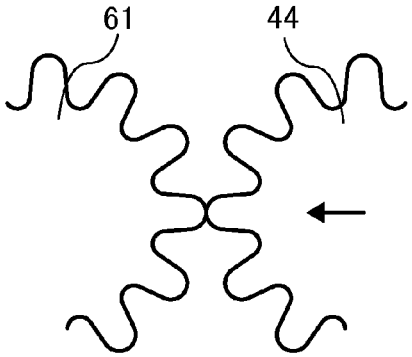
FIGS. 5A and 5B are schematic diagram illustrating a drive gear of the image forming apparatus and a driven gear of the fixing unit according to the example embodiment.
Figure 5B:
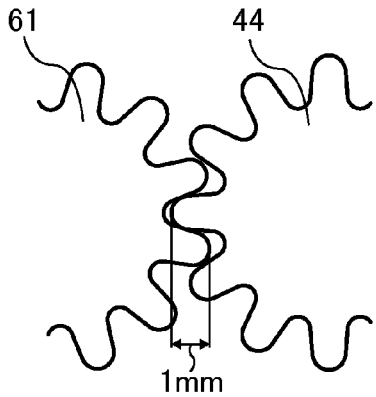

As shown in FIG. 5B, the module for both the gears 44 and 61 is approximately 1, and the mesh length of the tooth is approximately 1 mm.

Therefore, as shown in FIG. 5A, when the fixing unit 19 is installed in the image forming apparatus 1 in a direction shown by an arrow, the tip of teeth of both gears 44 and 61 may collide against each other.

Consequently, the gear 44 and the gear 61 may not adequately mesh with each other, thereby causing inadequate transmission of the driving force to the fixing unit 19.

However, even if the driving force is not adequately transmitted to the fixing unit 19, the connectors 44 and 61 may still be connected and conducted. For this reason, it is detected that the fixing unit 19 is properly installed in the image forming apparatus 1, and the supporting roller 23 is not properly driven.

In order to reduce the likelihood of (if not prevent) the gears 44 and 61 from colliding with one another as shown in FIG. 5A at the time of installation of the fixing unit 19, the gear tooth peak of the gears 44 and 61 may have a flat cut out. Furthermore, a gap in a rotary direction may be provided to the driven gear 44.

On the other hand, when the result is NO in Step S12, that is, when the variable K does not reach REF1, it is possible that the first notification has not been made in the past, and thus the user has not reinstalled the fixing unit 19.

The problem of the operation in the supporting roller 23 may be associated with an improper installation of the fixing unit 19. Subsequently, "1" is added to the variable K in Step S15.

After Step S15, the first notification reporting an improper installation of the fixing unit 19 is made on the display/operation panel in Step S16.

Subsequently, whether or not the cover has been opened and closed is confirmed in Step S17.

When the result is YES in Step S17, that is, when it is confirmed that the cover has been opened and closed, the variable C is set to "1" in Step S18.

Subsequently, the display of the first notification requesting the user to properly install the fixing unit 19 is cancelled in Step S19.

According to the first example embodiment, a hypothetical value of the reference number REF1 was assumed to be 1.

However, the reference number REF1 can take other values, e.g., 2. Accordingly, when the first notification is made more than once, it is expected that the user is able to reinstall the fixing unit 19.

In this case, when the first notification is made for the second time, a message, for example, "Please reinstall the fixing unit again" and the like may be displayed.

According to the first example embodiment, in a case where the first detector detects an installation of the fixing unit 19, and the second detector does not detect the driving of the supporting roller 23, the first notification is made when the variable K indicating the number of the first notifications made and stored in the memory 72 is less than the reference number REF1.

When the variable K indicates the reference number REF1, the second notification is made. Accordingly, when a problem in the operation of the fixing unit or the supporting roller 23 is associated with the improper installation of the fixing unit, a need for requesting a repair personnel to repair the problem may effectively be reduced.

Figure 8:
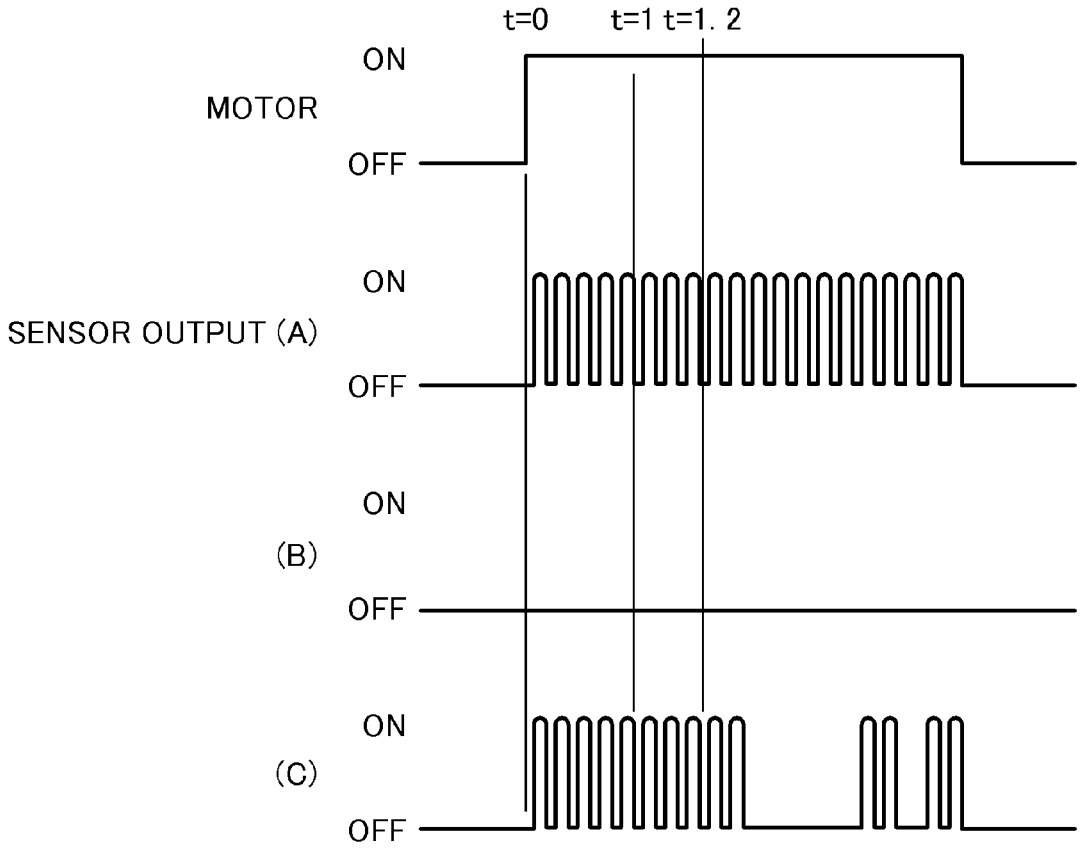
FIG. 8 is a timing chart showing an output signal of a second detector according to the example embodiment.
Figure 9:
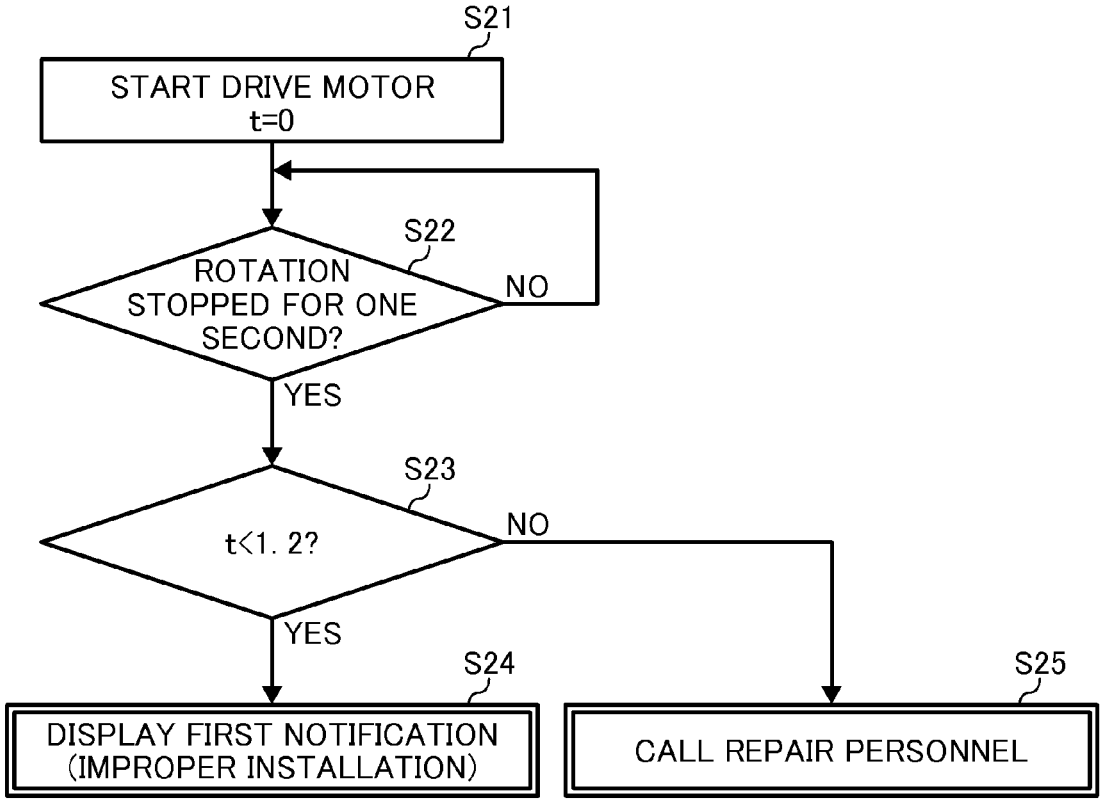
FIG. 9 is a flowchart showing an example procedure of a control operation performed by a second detector according to the example embodiment.

Referring now to FIGS. 8 and 9, a description will be given of the photosensor 48 serving as the second detector.

As shown in FIG. 8 (A), when there is no abnormal behavior in the fixing unit 19, the photosensor 48 may detect the detected plate 47 as the drive motor 60 operates. The output signal of the photosensor 48 may include on and off signals that are regularly repeated.

On the other hand, when the problem that the transmission of the driving force is insufficient due to an improper installation of the fixing unit 19 occurs as described above, the output signal of the photosensor 48 is either an off-signal (or on-signal) and may remain unchanged as shown in FIG. 8 (B).

Furthermore, when other problems described above, such as a damage to the driving force transmission system from the drive motor 60 to the driven gear 44, or a slip of the fixing belt 22 or the fixing auxiliary roller 21 relative to the pressure roller 30, or a slip of the supporting roller 23 relative to the fixing belt 22 occur, the output signal from the photosensor 48 may irregularly fluctuate between on and off signals as shown in FIG. 8 (C).

This is because the problem in driving of the supporting roller 23 irregularly occurs.

Therefore, according to the first example embodiment, when the photosensor 48 does not detect the driving of the supporting roller 23 until a reference time elapses after the drive motor 60 starts to operate, the first notification is made.

When the photosensor 48 does not detect the driving of the supporting roller 23 after detecting the driving of the supporting roller 23, that is, after detecting the normal driving of the supporting roller 23, until the reference time elapses, the second notification is made.

Referring now to FIG. 9, there is shown a flowchart of an example procedure (e.g., performed by the control unit 70) of the operation of the second detector.

When the driving of the drive motor 60 is initiated in Step S21, the photosensor 48 serving as the second detector may repeatedly perform detection of the driving of the supporting roller 23 for every second in Step S22.

When the result is NO in step S22, that is, the photosensor 48 detects that the supporting roller 23 is not rotatively driven, then flow proceeds to Step S23. At Step S23, it is determined whether or not the time (t) from which the drive motor 60 starts to operate until the time the photosensor 48 detects that the supporting roller 23 is not rotatively driven is within a given time, e.g., 1.2 seconds.

When the result is YES in Step S23, that is, the time (t) is no more than 1.2 seconds, the first notification reporting an improper installation of the fixing unit 19 is made in Step S24, assuming that the waveform of the output signal of the photosensor 48 is similar to, if not the same as the waveform shown in FIG. 8 (B).

On the other hand, when the result is NO in Step S23, that is, the time (t) is more than 1.2 seconds, the second notification requesting the user to call a repair personnel is made in Step S25, assuming that the waveform of the output signal of the photosensor 48 is similar to, if not the same as the waveform shown in FIG. 8 (C).

Thereby, it is possible to distinguish the causes of the problem detected by the photosensor 48 serving as the second detector and inform the user of an appropriate notification.

As described above, according to the first example embodiment, when the installation of the fixing unit 19 is detected, but the driving of the supporting roller 23 of the fixing unit 19 is not detected, an appropriate notification is made to the user.

Accordingly, it is possible to reduce a need for requesting a repair personnel to repair the problem when the problem which is most likely to be solved by the reinstallation the fixing unit 19 occurs. Furthermore, it is possible to reduce the time during which the image forming apparatus stops its operation.

In the first example embodiment, the present invention may be applied to the fixing unit 19 as a representative example of a component detachably provided to the image forming apparatus.

However, the present invention according to the first example embodiment may be applied to other components detachably provided to the image forming apparatus such as the process cartridge 4, the exposure unit 3, the transfer unit 13, and so forth.

The fixing unit according to the first example embodiment may use an electromagnetic induction heating method. However, the present invention may be applied to a fixing unit using a different method, for example, a thermal heating method or the like.

The present invention may be applied to a portion of the fixing unit 19, for example, the second holder 20 when the portion of the fixing unit 19 is detachable from the image forming apparatus 1.

In such a case, the similar, if not the same effect may be achieved.

Furthermore, the first example embodiments may not be limited to the first, second and third detectors. The same may be varied in many ways.

Figure 10:
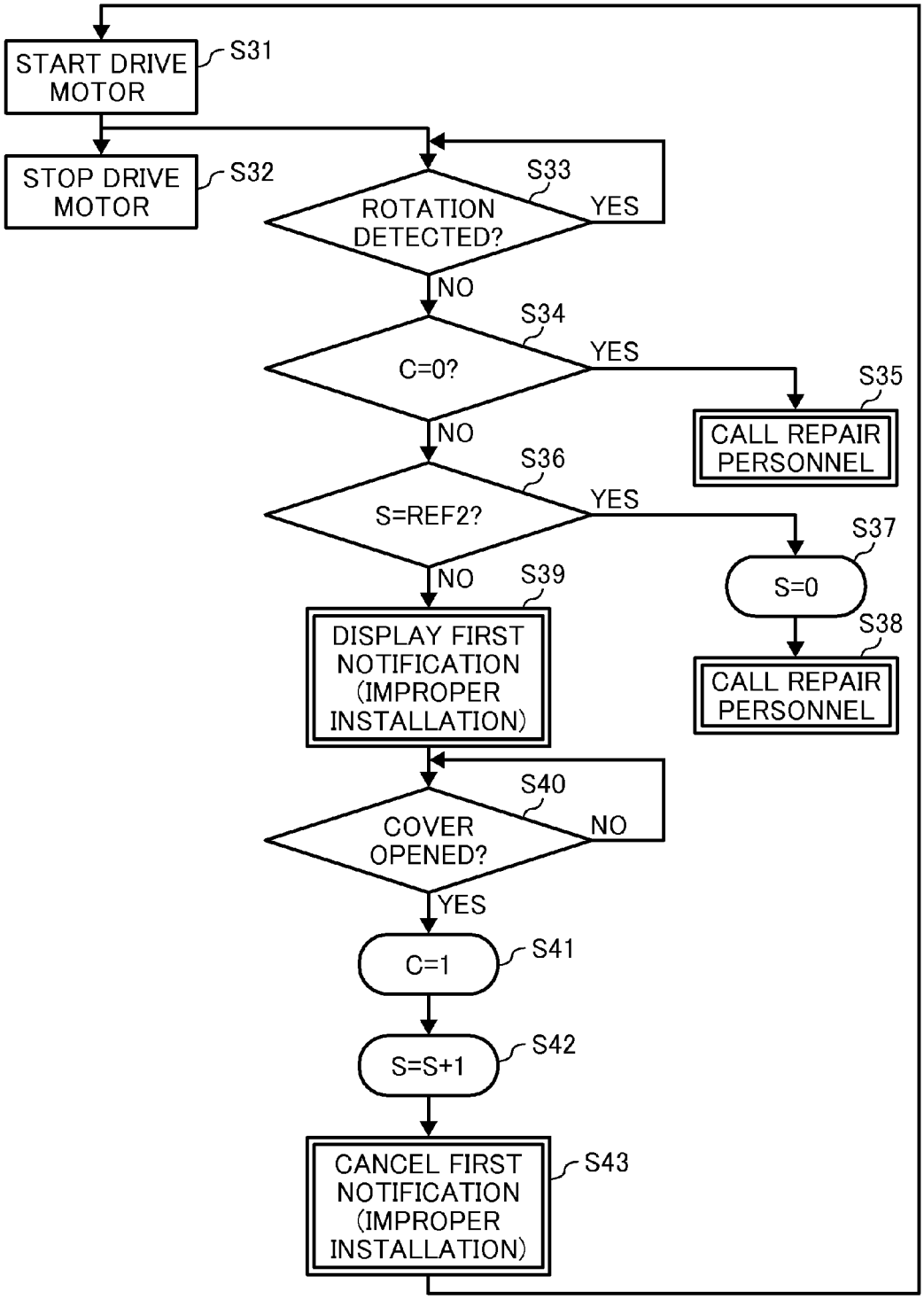
FIG. 10 is a flowchart showing an example notification procedure of the image forming apparatus according to another example embodiment of the present invention.

Referring now to FIG. 10, there is shown a flowchart of a notification procedure according to a second example embodiment of the present invention.

FIG. 10 shows a notification procedure performed by the control unit 70 of the image forming apparatus according to the second example embodiment. FIG. 10 may correspond to FIG. 7B of the first example embodiment.

In the second example embodiment, the first or the second notification is made based on a variable S, which may indicate a number/count of occurrences of the first notification.

On the contrary, in the first example embodiment, the first or the second notification is made based on the variable K which is a number of the first notification that has been made.

As shown in FIG. 10, when the drive motor 60 is initiated in Step S31, similar to the first example embodiment, the detection of the rotation or the driving of the supporting roller 23 is performed in Step S33 until the driving of the supporting roller 23 stops in Step S32.

When the result is YES in Step S33, that is, when the proper driving of the supporting roller 23 is detected, the detection operation performed in Step S33 may continuously be performed.

On the other hand, when the driving or the rotation of the supporting roller 23 is not detected in Step S33, whether or not the variable (C) indicates 0 (C=0) is determined in Step S34.

When the result is YES in Step S34, that is, the variable (C) indicates 0 (C=0), the second notification is made on the display/operation panel assuming that there is possibility of an improper installation of the fixing unit 19 in Step S35.

On the other hand, when the result is NO in Step S34, there is a possibility that the fixing unit 19 is improperly installed. Flow proceeds to Step S34, where it is determined whether or not the variable S indicates REF2 (a reference number), e.g., REF2=1 such that the determination is whether S=1.

The variable S is a number of the cancellation of the first notification made on the display/operation panel.

When the result is YES in Step S36 for REF2=1, then the first notification may have been cancelled once, and thus it is expected that the user has reinstalled the fixing unit 19.

Accordingly, the problem in the driving of the supporting roller 23 may not be associated with the improper installation of the fixing unit 19. Therefore, in Step S37, zero (0) is entered in the variable S without making the first notification again.

Subsequently, in Step S38, the second notification requesting the user to call a repair personnel is made on the display/operation panel.

On the other hand, when the result is NO in Step S36, that is, the variable S does not indicate the reference number REF2, it is possible that the first notification has not been cancelled, and thus the user has not reinstalled the fixing unit 19.

The problem in the driving of the supporting roller 23 may be associated with the improper installation of the fixing unit 19. Therefore, in Step S39, the first notification reporting an improper installation of the fixing unit 19 may be made.

Subsequently, in Step S40, opening and closing of the cover is confirmed. When opening and closing of the cover is confirmed, 1 is entered in the variable C in Step S41.

Furthermore, 1 is added to the variable S in Step S42. In Step S43, the first notification (output by the indicator device 64, notifying the user of the improper installation of the fixing unit 19) is cancelled.

As described above, according to the second example embodiment, when the first detector detects an installation of the fixing unit 19, and the second detector does not detect driving of the supporting roller 23, the first notification is made when the variable S which is the number of cancellation made to the first notification and stored in the memory 72 is less than 1.

When the variable S is at least 1, the second notification is made. Thereby, it is possible to reduce a need for requesting a repair personnel to repair when the problem in the fixing unit (the supporting roller 23) is associated with the improper installation of the fixing unit.

As described above, according to the second example embodiment, similar to the first example embodiment, in a case where an installation of the fixing unit 19 which is a component detachably provided to the image forming apparatus is detected, and the driving of the supporting roller 23 (driven member) is not detected, an appropriate notification may be made to the user.

Thereby, it is made possible to reduce a need for requesting a repair personnel to repair the problem when the problem which is most likely to be solved by reinstallation the fixing unit 19 occurs.

Furthermore, it is made possible to reduce the time during which the image forming apparatus stops its operation.

According to the example embodiments described above, the fixing unit is installed in a monochrome image forming apparatus. However, the fixing apparatus of the example embodiments may be installed in a color image forming apparatus.

Furthermore, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

One or more embodiments of the present invention may be conveniently implemented using a conventional general purpose digital computer programmed according to the teachings of the present specification, as will be apparent to those skilled in the computer art.

Appropriate software coding can readily be prepared by skilled programmers based on the teachings of the present disclosure, as will be apparent to those skilled in the software art.

One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Furthermore, any of the aforementioned methods may be embodied in the form of a program. The program may be stored on a computer readable media and is adapted to perform any one of the aforementioned methods, when run on a computer device (a device including a processor).

Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of a built-in medium include, but are not limited to, rewriteable non-volatile memories, such as ROMs and flash memories, and hard disks.

Examples of a removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such example variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited not limited to any of the structure for performing the methodology illustrated in the drawings.

What is claimed is:

1. An image forming apparatus, for forming an image, comprising:

a component, detachable from the image forming apparatus, including a driven portion;

a first detector configured to detect an installation of the component in the image forming apparatus;

a second detector configured to detect driving of the driven portion;

an indicator device configured to communicate information to a user; and a controller to control, for a circumstance in which the first detector detects an occurrence of installation of the component and the second detector does not detect driving of the driven portion, the indicator device to provide the following, a first notification requesting a proper installation of the component when a first count of occurrences of the first notification or a second count of occurrences of cancellation of the first notification is less than first and second reference values, respectively, and a second notification requesting repair when the first count or the second count equals the first and second reference values, respectively.

2. The image forming apparatus according to claim 1, wherein the first and second counts of occurrences, respectively, are stored in a memory.

3. The image forming apparatus according to claim 2, wherein the memory is non-volatile.

4. The image forming apparatus according to claim 1, wherein the controller resets the first count or the second count, respectively, when the second notification is provided.

5. The image forming apparatus according to claim 1, wherein the controller causes outputting of the first notification if the second detector does not detect driving of the driven portion before a first reference time elapses after the driver starts to operate, and causes outputting of the second notification when the second detector does not detect driving of the driven portion before a second reference time elapses after the second detector detects the driving of the driven portion.

6. The image forming apparatus according to claim 1 further comprising:

a third detector configured to detect whether or not the image forming apparatus is ready for installation of the component, wherein the controller causes outputting of the second notification when the first detector detects an occurrence of installation of the component, the second detector does not detect driving of the driven portion and the third detector detects that the image forming apparatus is not ready for installation.

7. The image forming apparatus according to claim 5, wherein the image forming apparatus is assumed to be ready for installation of the component when a power of the image forming apparatus is turned off.

8. The image forming apparatus according to claim 1, wherein the first detector detects an installation of the component in the image forming apparatus when detecting an exchange of an electric power between the image forming apparatus and the component.

9. The image forming apparatus according to claim 1, wherein values of the first and second references are one or two, respectively.

10. The image forming apparatus according to claim 1, wherein the component comprises:

a fixing unit or a portion thereof configured to fix a toner image on a recording medium.

11. The image forming apparatus according to claim 9, wherein the fixing unit comprises:

a fixing member;

a magnetic flux generator configured to directly or indirectly heat the fixing member with a magnetic flux; and a rotary member disposed facing the magnetic flux generator, wherein the second detector detects a rotation of the rotary member.

12. The image forming apparatus according to claim 10 further comprising:

a detected plate configured to rotate in conjunction with the rotation of the rotary member, wherein the second detector is a photosensor optically detecting the rotation of the detected plate.

13. A method of outputting a notification from an image forming apparatus that includes a component detachable from the image forming apparatus and having a driven portion, the method comprising:

detecting a first condition of an installation of the component in the image forming apparatus;

detecting a second condition of driving the driven portion;

an indicator device configured to communicate information to a user; and outputting to a user, for a circumstance in which the first condition is detected but the second condition is not detected, the following, a first notification requesting a proper installation of the component when a first count of occurrences of the first notification or a second count of occurrences of cancellation of the first notification is less than first and second reference values, respectively, and a second notification requesting repair when the first count or the second count equals the respective reference value.

14. The method according to claim 13, further comprising:

resetting the first count or the second count, respectively, when the second notification is provided.

15. The method according to claim 13, further comprising:

outputting the first notification if the second condition is not detected before a first reference time elapses after the driven portion begins to be driven; and outputting the second notification when the second condition is not detected before a second reference time elapses after the driven portion begins to be driven.

16. The method according to claim 13 further comprising:

detecting a third condition of whether the image forming apparatus is ready for installation of the component; and outputting the second notification when the first condition is detected, the second condition is not detected, and the third condition is not detected.

17. The method according to claim 16, further comprising:

assuming the image forming apparatus is ready for installation of the component when a power of the image forming apparatus is turned off.

18. The method according to claim 13, wherein the detecting of the first condition includes detecting an exchange of an electric power between the image forming apparatus and the component.

19. The method according to claim 13, wherein values of the first and second references are one or two, respectively.

20. The method according to claim 13, wherein:

the component includes a fixing unit or a portion thereof configured to fix a toner image on a recording medium;

the fixing unit includes the following, a fixing member, a magnetic flux generator configured to directly or indirectly heat the fixing member with a magnetic flux, and a rotary member disposed facing the magnetic flux generator; and the detecting of the second condition includes detecting rotation of the rotary member.

* * * * *